US010494312B2

(12) United States Patent
Senules

(10) Patent No.: US 10,494,312 B2
(45) Date of Patent: Dec. 3, 2019

(54) NOBLE GAS INFUSED EMULSION EXPLOSIVE

(71) Applicant: Jeffrey S. Senules, Crystal River, FL (US)

(72) Inventor: Jeffrey S. Senules, Crystal River, FL (US)

(73) Assignee: Jeffrey S. Senules, Crystal River, FL (US)

( * ) Notice: Subject to any disclaimer, the term of this patent is extended or adjusted under 35 U.S.C. 154(b) by 0 days.

(21) Appl. No.: 15/326,682

(22) PCT Filed: Jul. 8, 2015

(86) PCT No.: PCT/US2015/039510

§ 371 (c)(1),
(2) Date: Jan. 17, 2017

(87) PCT Pub. No.: WO2016/010783

PCT Pub. Date: Jan. 21, 2016

(65) Prior Publication Data

US 2017/0204020 A1 Jul. 20, 2017

Related U.S. Application Data

(60) Provisional application No. 62/026,074, filed on Jul. 18, 2014.

(51) Int. Cl.

| | |
|---|---|
| ***C06B 47/00*** | (2006.01) |
| ***C06B 23/00*** | (2006.01) |
| ***C06B 47/14*** | (2006.01) |
| *D03D 23/00* | (2006.01) |
| *D03D 43/00* | (2006.01) |

(52) U.S. Cl.
CPC ..... *C06B 23/00* (2013.01); *C06B 47/145* (2013.01)

(58) Field of Classification Search
USPC ..... 149/109.4
See application file for complete search history.

(56) References Cited

U.S. PATENT DOCUMENTS

| | | | | |
|---|---|---|---|---|
| 3,447,978 | A | 6/1969 | Bluhm | |
| 3,674,578 | A | 7/1972 | Cattermole et al. | |
| 4,110,134 | A | 8/1978 | Wade | |
| 4,343,663 | A | 8/1982 | Breza et al. | |
| 4,594,118 | A | 6/1986 | Curtin et al. | |
| 4,756,776 | A * | 7/1988 | Halliday | C06B 21/005 102/430 |
| 4,936,933 | A | 6/1990 | Yabsley et al. | |
| 8,114,231 | B2 | 2/2012 | da Silva et al. | |
| 2003/0075908 | A1* | 4/2003 | Rink | B60R 21/264 280/736 |
| 2007/0277916 | A1* | 12/2007 | Halander | C06B 21/0008 149/109.6 |
| 2010/0206441 | A1 | 8/2010 | Baran, Jr. et al. | |
| 2011/0241230 | A1 | 10/2011 | Kerfoot | |

FOREIGN PATENT DOCUMENTS

| | | | |
|---|---|---|---|
| WO | 2013/013272 | A1 | 1/2013 |

OTHER PUBLICATIONS

Wlodarczyk, E., "Analysis of the Efficiency of Initiation of Detonation by 'Hot Spots' Generated by Shock Compression of Gas Bubbles Included in the Explosive Part I. Analysis of the Experimental Data". Journal of Technical Physics, J. Tech Phys, 33, 1, pp. 35-61, 1992.

* cited by examiner

*Primary Examiner* — James E McDonough
(74) *Attorney, Agent, or Firm* — The Webb Law Firm

(57) ABSTRACT

Provided is an emulsion explosive composition having voids/bubbles formed from one or more noble gases dispersed therein. Also provided is a method of manufacturing an emulsion explosive composition that includes mechanically and/or pneumatically infusing an emulsion explosive composition with a noble gas so as to create voids/bubbles formed from one or more noble gases. The noble gases can be contained within closed-cell micro-spheres that are dispersed throughout the emulsion explosive composition.

7 Claims, No Drawings

NOBLE GAS INFUSED EMULSION EXPLOSIVE

CROSS-REFERENCE TO RELATED APPLICATIONS

This application is the United States national phase of International Application No. PCT/US2015/039510 filed Jul. 8, 2015, and claims benefit of U.S. Provisional Patent Application No. 62/026,074 filed Jul. 18, 2014, the disclosures of which are hereby incorporated in their entirety by reference.

BACKGROUND OF THE INVENTION

Field of the Invention

This invention relates to emulsion explosives, and more particularly to an emulsion explosive composition that includes voids/bubbles formed from a noble gas dispersed therein.

Description of Related Art

Emulsion explosives have been widely accepted in the explosives industry. These types of explosives are generally understood to include explosive compositions comprised of multiple, immiscible liquids. It is further known that emulsion explosive performance may be enhanced by the addition of a gaseous phase of voids/bubbles, preferably spherical in shape, to facilitate detonation. A reason for this is that during the primary phase of detonation, a super-sonic shock wave travels through the explosive charge which compresses the voids/bubbles contained therein. When the void/bubble rapidly compresses to high pressures, a large amount of heat is generated. Heat created by compressing and collapsing a void/bubble can generate sufficient temperatures to cause the decomposition and subsequent detonation of the surrounding explosive. Voids/bubbles used in emulsion explosives are commonly comprised of nitrogen, oxygen, or a mixture of both (including air). Voids/bubbles are generally added to emulsions by various methods such as, but not limited to, caviation, the addition of pre-manufactured closed celled micro-spheres, or chemical gassing. In recent years, chemical gassing has become the preferred method because of its low cost, excellent dispersion, ease of storage and transport, and density flexibility, among other advantages.

For example, U.S. Pat. No. 4,110,134 to Wade, which is expressly incorporated herein by reference, discusses a water-in-oil emulsion explosive composition that includes an occluded gas as well as an improved sensitizer-catalyst system. U.S. Pat. No. 3,447,978 to Bluhm and U.S. Pat. No. 3,674,578 to Cattermole, both of which are expressly incorporated herein by reference, each describe an emulsion type blasting agent that includes occluded air and offer advantages over slurry type explosives, but are not cap sensitive. U.S. Pat. No. 4,936,933 to Yabsley et al., which is expressly incorporated herein by reference, describes a process for mechanically entraining gas bubbles into an emulsion explosive. More recently, U.S. Pat. No. 8,114,231 to da Silva et al., which is expressly incorporated herein by reference, discusses a method for gassing an emulsion explosive with nitric oxide in order to sensitize the explosive to detonation and/or for density modification.

Despite the focus and advantages of including voids/bubbles within an emulsion explosive composition, very little attention has been given to selecting the type of gas that forms the void.

SUMMARY

Provided is an improved emulsion explosive composition as well as a method of manufacturing an improved emulsion explosive composition. In particular, the emulsion explosive composition of the present invention has, dispersed therein, voids/bubbles that are formed from one or more noble gases. The noble gases can include Rn, Xe, Kr, Ar, Ne, and He. In one non-limiting embodiment, the noble gases are selected from one or more of Ar and He.

In one non-limiting embodiment, the voids/bubbles consist entirely of a noble gas, or of more than one noble gas in combination. In another non-limiting embodiment, the voids/bubbles consist essentially of one or more noble gases and additionally include trace amounts of impurities.

In one non-limiting embodiment, the noble gases are in the form of entrained bubbles which are between 50 nm and 3 mm in size, such as between 100 nm and 3 mm in size, between 100 nm and 1 μm in size, or between 10 μm and 3 mm in size.

Also provided is a method of manufacturing an emulsion explosive composition as described above. The method includes mechanically and/or pneumatically infusing an emulsion explosive composition with a noble gas so as to create voids/bubbles comprised of one or more noble gases. In one non-limiting embodiment, the method involves the use of a micro-bubble generator and/or diffuser device that mechanically and/or pneumatically infuses an emulsion explosive composition with noble gas micro-bubbles that are between 50 nm and 3 mm in size, such as between 100 nm and 3 mm in size, between 100 nm and 1 μm in size, or between 10 μm and 3 mm in size.

DETAILED DESCRIPTION OF THE PREFERRED EMBODIMENTS

As used herein, all numbers expressing dimensions, physical characteristics, percentages, and the like, used in the specification and claims are to be understood as being modified in all instances by the term "about."

This invention is directed to an emulsion explosive composition in which voids/bubbles formed from a noble gas are dispersed therein. It has been discovered that when the voids/bubbles contained within an emulsion explosive composition are comprised of a noble gas, the voids/bubbles can generate more heat when compressed to collapse than in those instances where the voids/bubbles are comprised of other gases. This is believed to be due to compression phenomena unique to noble gases caused by the atomic structure thereof. The use of noble gases as discussed herein has been found to sensitize the emulsion explosive and improve the detonation process.

Any known emulsion explosive can be used as the base material in this invention to which the noble gas is added. For example, the emulsion explosive can be a water-in-oil emulsion that includes a discontinuous phase of an aqueous oxidizer solution having an oxidizer salt that is dispersed in a continuous phase of an organic fuel in the presence of one or more emulsifying agents. These types of emulsion explosives are well known in the art and are described in the above-cited United States patents, which are incorporated by reference.

The emulsion explosive of the present invention further includes voids/bubbles, and these voids/bubbles are comprised of one or more noble gases. The noble gases that can be used include Rn, Xe, Kr, Ar, Ne, and He. The most preferred noble gases are He and Ar. In certain embodiments, the voids/bubbles can be formed exclusively (i.e., consist of) one or more noble gases. In other embodiments, the voids/bubbles can be formed primarily, such as 85% by volume or more, from one or more noble gases along with small amounts of impurities (i.e., consist essentially of). In still other embodiments, the voids/bubbles contain some amount of a noble gas, such as 2% by volume or more, such as 5% or 25% by volume or more, along with other gases that are traditionally used in forming voids/bubbles in emulsion explosives, including nitrogen and oxygen. However, in each embodiment of the invention, the voids/bubbles contain more than a trace amount of noble gas, such as more than the small amount of noble gas that may be naturally present in atmospheric air. In addition to bubbles/voids containing noble gases, the emulsion explosive compositions can additionally include bubbles/voids formed from other gases, such as nitrogen, oxygen, and atmospheric air, which are discussed in the references cited above.

The use of a noble gas/gases can improve the thermal dynamics of a collapsing void. When a bubble is rapidly compressed by a shock wave, more heating occurs at its center than at its boundary because wave strength increases as it approaches center. With a noble gas, the atoms and/or molecules which make up the gas break down, or "ionize," into negatively charged electrons and positive ions. Another possibility is that during collapse and subsequent rapid increases in temperature, the noble gas will not react with surrounding material. For example, collapsing oxygen/nitrogen bubbles typically will react with the explosive once a sufficient temperature is achieved. However, a noble gas will not react and continue to collapse, eventually forming a plasma. Although the physics are not yet fully understood, it has been discovered that noble gases possess unique thermal dynamic properties which can produce more heat compared to other gasses when rapid compression occurs.

Following this basic principle, different noble gases, or different combinations of noble gases, can be selected based on the desired properties of the emulsion explosive composition and the known properties of the various noble gases. For example, based on the thermal conductivity of the noble gases, the amount of potential energy that can be converted into temperature should be largest with Xe and smallest for He. Thus, if a large temperature rise is desired, the voids/bubbles can be composed primarily or entirely of Xe, whereas if a small temperature rise is desired, the voids/bubbles can be composed primarily or entirely of He. However, it has also been observed that the ionization potential of the gas will factor into thermal potentials. He, for example, has a greater root-mean-square speed than Ar. Thus, while He may not be as thermally conductive as Ar, it may still create more heat when compressed due to an increase in kinetic-molecular energy. Once the desired characteristics of the emulsion explosive composition are known, including the amount of converted energy desired for detonation, routine experimentation and knowledge of the physical properties of the different noble gases will readily lead one of ordinary skill in the art to the ideal noble gas or combination of noble gases for use in the emulsion explosive composition. The ideal percentages and types of gasses can also vary based on viscosity of the emulsion and size of the bubbles.

The noble gases can be in the form of small entrained spheres contained within the emulsion explosive composition. Preferably, these micro-bubbles are between 50 nm and 3 mm in size, such as between 100 nm and 3 mm in size, between 100 nm and 1 μm in size, or between 10 μm and 3 mm in size, when compressed by either static or hydrostatic pressure that is typical in an emulsion explosive composition. The micro-bubbles should be evenly/homogenously dispersed throughout the emulsion in a discontinuous gaseous phase. The bubbles/voids should be present in an amount sufficient to facilitate a stable velocity of detonation. For instance, the percentage of bubbles can be between 0.05% and 60% by volume. Preferably, the density of the final emulsion explosive composition is between 0.04 g/cc and 1.40 g/cc.

Also provided are methods of manufacturing the emulsion explosive compositions described above. More particularly, provided are processes for infusing the emulsion explosive composition with voids/bubbles containing noble gas. One such process involves mechanically/pneumatically entraining gas bubbles that include noble gas. Processes for mechanically/pneumatically entraining gas bubbles have not, in the past, enjoyed much success and the technique is seldom used. One reason is that it is difficult to obtain small evenly dispersed bubbles by mechanical/pneumatic means. Bubble radius is also very important as it is important to obtain small bubbles that are spherical to maximize heat generated. However, newly available micro-bubble generators and diffusers, which would be known and available to those of skill in the art, make it possible to evenly entrain small gas bubbles in an emulsion explosive. To date, the materials showing the most promise are: carbon ceramic and porous glass. Carbon ceramic is preferred due to the phenomenon of the gas bubbles developing negative charges. A carbon ceramic diffuser has a very small and even pore size and use of a carbon ceramic diffuser can develop gas bubbles having a negative charge as they pass through the carbon ceramic. Gaining a slight negative charge is beneficial because the bubbles have less tendency to coalesce. This method provides certain benefits over chemical gassing and the use of pre-manufactured closed cell micro-spheres, though, as explained below, each of these provides viable options for practicing the current invention as well.

Another process involves adding pre-manufactured closed celled micro-sphere bubbles of noble gas. The micro-spheres typically contain a thin outer shell enclosing a cavity that can contain a gas therein. Such micro-spheres are known to have excellent spherical qualities and size conformity and it is believed that pre-manufactured closed celled micro-sphere bubbles with an outer shell and a noble gas contained therein would likewise exhibit excellent spherical qualities and size conformity. The gas may be enclosed within the micro-sphere under vacuum. Manufactured closed celled, self-contained bubbles do present some disadvantages, including high cost, increased emulsion viscosity, and the possibility that the outer shell can damage the emulsion phase and shorten shelf life depending on percentages used. In one embodiment, the emulsion explosive composition includes closed-cell micro-spheres that enclose one or more noble gases, and Ar is a particularly preferred gas.

The process should allow for the even distribution of the voids/bubbles throughout the emulsion explosive composition. The voids/bubbles can be added or infused to the liquid emulsion at any point between the liquid emulsion supply and the point of discharge of the final composition. The bubbles can be infused directly into the explosive composition or prepared in a separate fluid which is then added into the explosive composition. Commercially available materials that inhibit the coalescence of bubbles may also be added. These fluids can be pre-bubbled with a noble gas and then infused into the explosive composition.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements. For example, it is to be understood that the present invention contemplates that, to the extent possible, one or more features of any embodiment can be combined with one or more features of any other embodiment.

What is claimed is:

1. A method of manufacturing an emulsion explosive composition, comprising infusing an emulsion explosive composition with a noble gas so as to create voids/bubbles comprising one or more noble gases dispersed within the emulsion explosive composition, wherein the noble gas is passed through a carbon ceramic diffuser to create voids/bubbles having a negative charge.

2. The method of claim 1, wherein the voids/bubbles consist essentially of Ar, He, or a combination of Ar and He.

3. The method of claim 1, wherein the voids/bubbles are formed as closed-cell micro-spheres.

4. The method of claim 1, wherein the voids/bubbles consist of one or more noble gases.

5. The method of claim 1, wherein the voids/bubbles consist of Ar, He, or a combination of Ar and He.

6. An emulsion explosive composition produced according to the method of claim 1.

7. The method of claim 1, wherein the voids/bubbles are comprised of 85% by volume or more of one or more of Ar and He.

* * * * *